United States Patent [19]

Beach

[11] 4,378,826

[45] Apr. 5, 1983

[54] HYDRAULIC LOG SPLITTER

[75] Inventor: Michael E. Beach, East Troy, Wis.

[73] Assignee: Didier Corporation, Franksville, Wis.

[21] Appl. No.: 297,954

[22] Filed: Aug. 31, 1981

[51] Int. Cl.[3] ..... B27L 7/00

[52] U.S. Cl. ..... 144/193 A

[58] Field of Search ..... 144/193 R, 193 A, 3 K, 144/193 K

[56] References Cited

U.S. PATENT DOCUMENTS 4,073,325 2/1978 Krom, Jr. ..... 144/193 A 4,303,112 12/1981 Sconce ..... 144/193 A

*Primary Examiner*—W. D. Bray

*Attorney, Agent, or Firm*—Bayard H. Michael

[57] ABSTRACT

The log splitter has a tie rod hydraulic cylinder which connects the beam to the wheeled assembly including the engine and hydraulic pump. The hydraulic cylinder is the only structural connection between the assembly and the beam. The high loads on the cylinder head are transferred to a butt plate on the beam end to which the tie rods are connected. Therefore, the connection of the hydraulic cylinder to the wheeled assembly does not impose high loads on the assembly.

2 Claims, 3 Drawing Figures

70 R

HYDRAULIC LOG SPLITTER

TECHNICAL FIELD OF THE INVENTION

This invention relates to the construction of log splitters.

BACKGROUND OF THE INVENTION

Log splitters generally have a beam which carries a hydraulic ram powered by a gasoline engine. To save shipping expense the usual practice has been to assemble and crate the engine/wheel part of the machine separate from the beam assembly on which the ram is mounted. The purchaser connects the two assemblies. The manufacturer has problems in that the shipping department may not ship the correct crates resulting in a mismatch of assemblies. The purchaser has to connect the hydraulic ram and pump with danger of leaks and dirt in the hydraulic system. The welded hydraulic cylinder used in the past is an expensive part but was well suited to the type of mounting on the beam.

SUMMARY OF THE INVENTION

The object of this invention is to reduce the cost and weight of a log splitter. To carry out this object I use a less expensive hydraulic cylinder of the type having the heads fixed on the cylinder by tie rods. These rods add strength to the cylinder and permit the cylinder to serve as a structural member. The tie rods are used to connect one end of the cylinder to a mounting plate which is part of the engine/wheel assembly. The tie rods at the other end of the cylinder are then connected to a butt plate on one end of the beam. The high forces on the cylinder head remote from the end of the cylinder connected to the beam are transmitted to the butt plate through the tie rods. The loads imposed on the mounting plate at the axle are minor. Where the beam in prior splitters ran the total length of the machine the present design uses the tie rod hydraulic cylinder as a beam for its length thus saving that much length (and weight) of beam in the art. The cylinder is about 47% of the total "beam length" so the actual beam in this design is reduced by 45% (or is only 55% as long as the comparable prior construction). The cost is reduced by the beam saving and the use of the less expensive tie rod cylinder. Further savings are realized in that the beam can now fit in the same crate as the wheel assembly (instead of requiring two crates). This reduces crating costs, inventory costs (and errors) and shipping costs (which are based on both weight and number of boxes). A final benefit is that the assembly of the purchaser is simply the connection of the beam to the tie rods, all hydraulic connections having been made by the manufacturer.

DETAILED DESCRIPTION OF THE DRAWINGS

Figure 1:
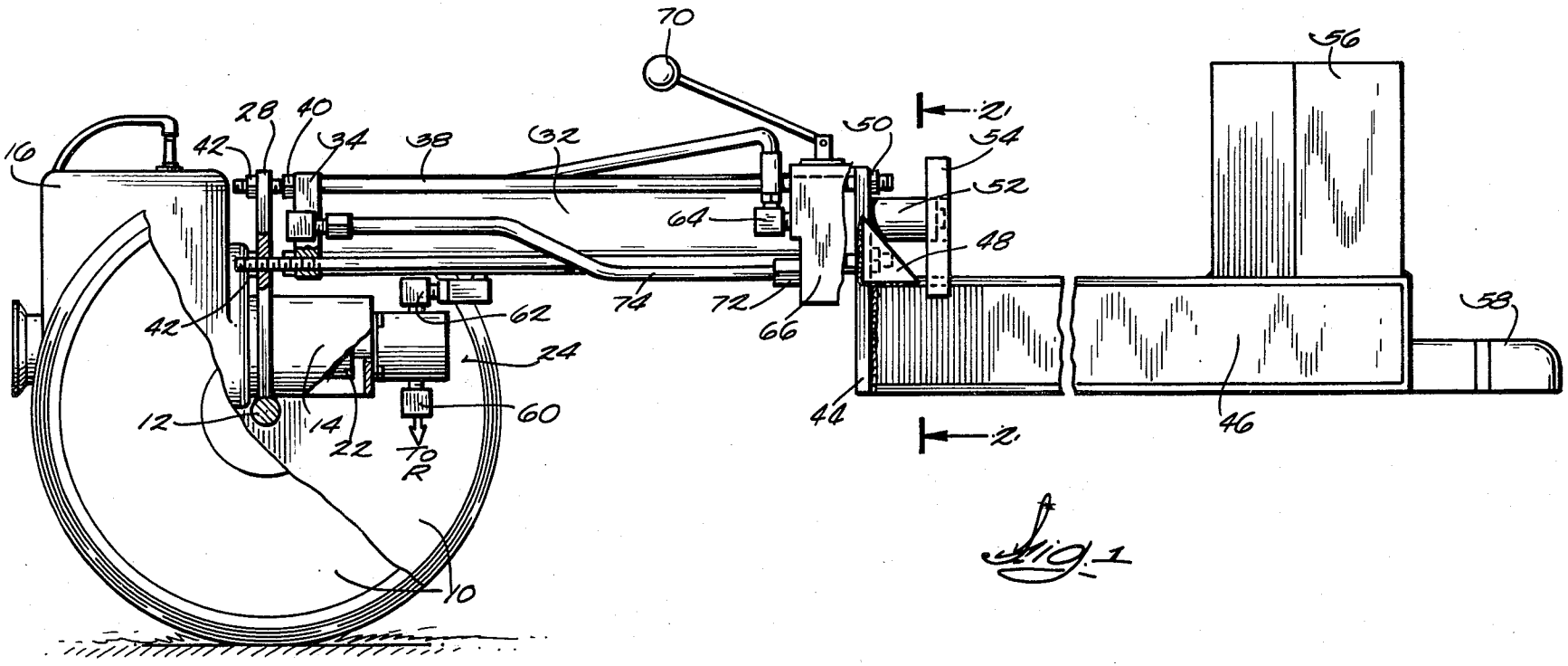
FIG. 1 is a side elevation of a log splitter with some parts broken away to show the details of the mounting and with a portion of the beam removed.
Figures 2, 3:
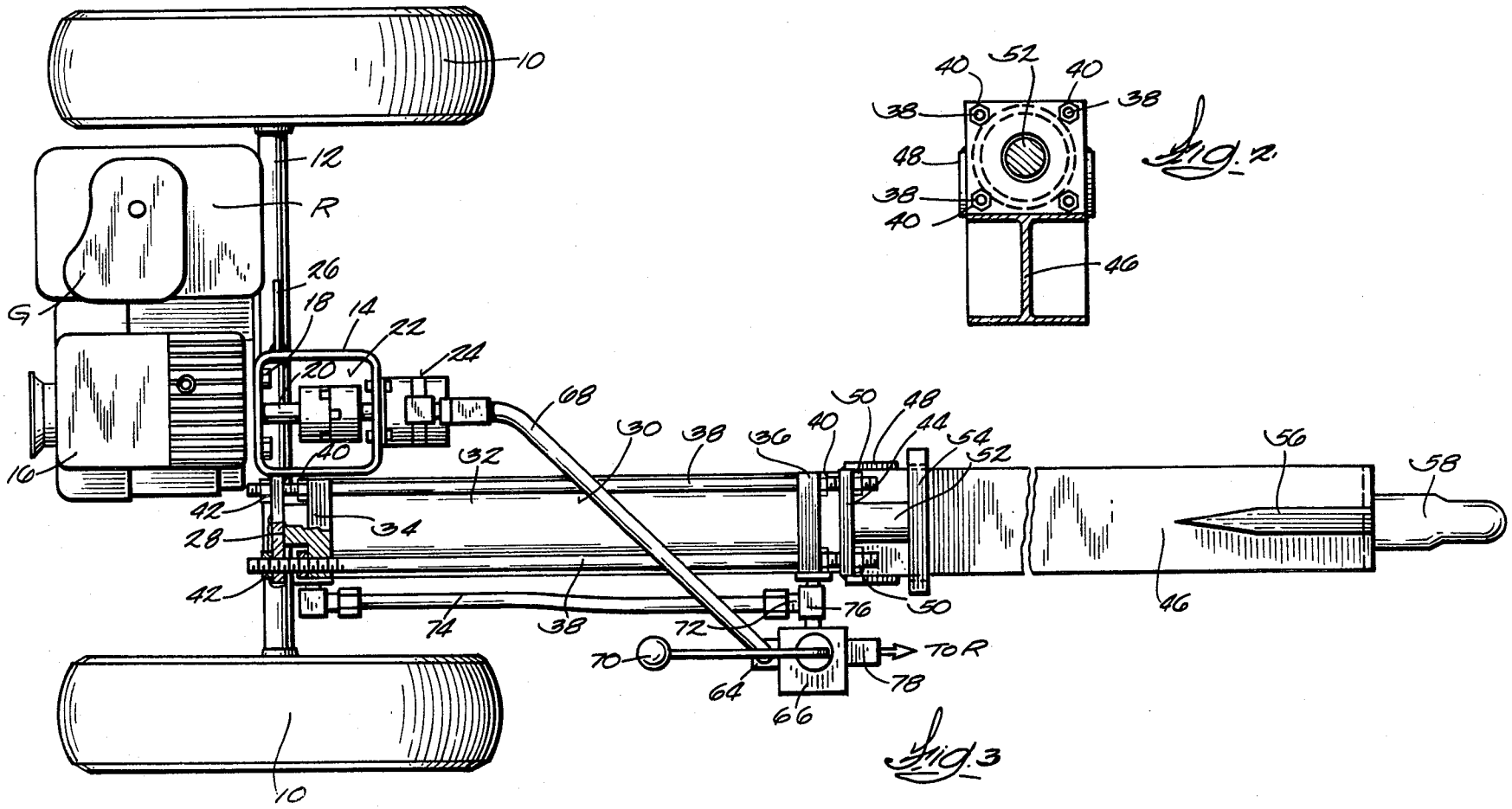
FIG. 2 is a vertical section on line 2—2 in FIG. 1.
FIG. 3 is a top plan view of the splitter shown in FIG. 1.

The wheels 10 are carried on the ends of axle 12 which has rectangular tube or box 14 welded thereto. The engine 16 is mounted on the box by bolts 18 with the engine drive shaft 20 projecting into the box. Coupling 22 connects the shaft to the input shaft of hydraulic pump 24 mounted on the box. The hydraulic fluid reservoir R is mounted below the engine gas tank G. Fillet 26 is welded to the box and the axle to brace the box on one side while mounting plate 28 is welded to the box and axle on the other side to brace the box and serve as the mounting for the tie rod cylinder 30.

The tie rod cylinder 30 comprises a tube 32 provided with an end plate or head 34 and a rod-end head 36 sealingly held on the ends of the tube by tie rods 38 and bolts 40. The tie rods are extra long so they project beyond the associated head 34 or 36. Each head is provided with a shoulder or rim against which the bolts seat while the head projects beyond the bolts. The left end of the tie rod cylinder is secured to the mounting plate 28 by extending the tie rods 38 through the plate and tightening nuts 42 until head 34 is tight against plate 28. The other end of tie rods pass through butt plate 44 welded on the end of beam 46 and braced by fillets 48. Nuts 50 are drawn up until the head 36 is tight against plate 44 (this being the one connection for the purchaser to make). Thus the tie rod cylinder connects the engine/wheel assembly to the beam and functions as a structural member just as the beam. In operation the high loads on the cylinder head 34 must be opposed. In this design the tie rods transmit the cylinder head load to the butt plate 44 . . . not to plate 28.

The piston shaft 52 extends through head 36 and has push block 54 fixed to the end. Wear plates can be secured on the sides of the block. As the ram extends the push block forces the log against the splitter wedge 56 welded on the right end of the beam. As customary, a trailer coupling 58 can be provided.

The hydraulic system is conventional. The pump inlet 60 is connected to reservoir R and outlet 62 is connected to the inlet 64 of control valve 66 by tubing 68. Operation of the valve handle 70 can direct hydraulic fluid from the lower outlet 72 to the left head 34 of the cylinder via tube 74 or from the upper valve outlet 76 to the right head 36. Low pressure fluid returning to the valve 66 goes out port 78 to the reservoir (via tubing not shown). Operation of the splitter is conventional.

It will be apparent the engine/wheel/cylinder assembly can be completed at the factory as can the beam assembly. The two assemblies are connected simply by tightening the 4 nuts 50. The product can be pre-wired for running lights if desired with a simple plug in wiring connector at the cylinder/beam joint.

It will be noted the tie rods extending from the left (head) end of the cylinder effectively transfer the force on the head back to butt place 44. For simple "tractor" operation (using the tractor hydraulics) just the cylinder and beam are required as compared to prior designs mounting a conventional welded cylinder on a (full length) beam. In such prior designs the head of the cylinder bears against a butt plate (similar to plate 44 and fillet 48) on the end of the beam opposite the wedge end. With this "tractor" design in mind it will be obvious the stress or load on plate 28 is not great. The real load is tension of the tie rods and is transmitted to butt plate 44.

I claim:

1. A log splitter comprising, a beam, a splitting wedge mounted at one end of the beam, a butt plate fixed on the other end of the beam, a hydraulic ram including a tie rod cylinder in which tie rods interconnect the cylinder head and the piston rod end head, the piston rod end of said ram being mounted on said plate by said tie rods with the cylinder head projecting away from the beam, a push plate connected to the piston rod of said ram to push logs resting on the beam against said wedge.

2. A log splitter according to claim 1 including a wheel and axle assembly, an engine mounted on the assembly, a mounting plate connected to the assembly and having said cylinder head connected thereto by said tie rods, said hydraulic ram constituting the sole structural connection between said assembly and said beam.

* * * * *

UNITED STATES PATENT AND TRADEMARK OFFICE

CERTIFICATE OF CORRECTION

PATENT NO. : 4,378,826

DATED : April 5, 1983

INVENTOR(S) : Michael E. Beach

It is certified that error appears in the above—identified patent and that said Letters Patent is hereby corrected as shown below:

Column 1, line 41, "47%" should read -- 45% --.

Column 1, line 51, the word "of" should read -- by --.

Column 2, line 30, the word "to" should read -- in --.

Signed and Sealed this

*Sixteenth* Day of *August 1983*

[SEAL]

*Attest:*

GERALD J. MOSSINGHOFF

*Attesting Officer*

*Commissioner of Patents and Trademarks*